US008657414B2

(12) United States Patent
Nielsen et al.

(10) Patent No.: US 8,657,414 B2
(45) Date of Patent: Feb. 25, 2014

(54) FLUID-EJECTION PRINTHEAD DIE HAVING AN ELECTROCHEMICAL CELL

(75) Inventors: Jeffrey A. Nielsen, Corvallis, OR (US); Sadiq Bengall, Corvallis, OR (US); Greg Scott Long, Corvallis, OR (US); Joshua M. Yu, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 165 days.

(21) Appl. No.: 13/320,028

(22) PCT Filed: Jul. 27, 2009

(86) PCT No.: PCT/US2009/051871

§ 371 (c)(1), (2), (4) Date: Nov. 11, 2011

(87) PCT Pub. No.: WO2011/014157

PCT Pub. Date: Feb. 3, 2011

(65) Prior Publication Data

US 2012/0056943 A1 Mar. 8, 2012

(51) Int. Cl.

| | |
|---|---|
| ***B41J 2/05*** | (2006.01) |
| ***B41J 29/393*** | (2006.01) |
| ***B41J 2/06*** | (2006.01) |

(52) U.S. Cl.

USPC ..... 347/63; 347/19; 347/55

(58) Field of Classification Search

USPC ..... 347/63

See application file for complete search history.

(56) References Cited

U.S. PATENT DOCUMENTS

| | | | | |
|---|---|---|---|---|
| 5,221,934 | A | 6/1993 | Long | |
| 6,084,605 | A | 7/2000 | Yaji | |
| 6,322,182 | B1 | 11/2001 | Lin et al. | |
| 6,467,888 | B2 | 10/2002 | Wheeler et al. | |
| 6,929,343 | B2 | 8/2005 | Farr et al. | |
| 7,253,644 | B2 | 8/2007 | Song | |
| 2007/0153032 | A1 * | 7/2007 | Chou et al. | 347/7 |

FOREIGN PATENT DOCUMENTS

| | | | |
|---|---|---|---|
| EP | 1057638 | A2 | 12/2000 |
| JP | 2004243664 | A | 9/2004 |
| JP | 2004345326 | A | 12/2004 |

OTHER PUBLICATIONS

Eldrige et; "In-Situ Monitoring of Heater Failure in Thermal Ink Jet Devices", IBM Technical Diasclosure Bulletin, US, vol. 34, No. 3, Aug. 1991, pp. 411-414.

Supplementary European Search Report for Application No. EP09847901.7. Report issued Feb. 19, 2013.

* cited by examiner

*Primary Examiner* — Lisa M Solomon

(57) ABSTRACT

A fluid-ejection printhead die includes a fluid-ejection firing element and an electrochemical cell. The fluid-ejection firing element is to cause droplets of fluid to be ejected from the fluid-ejection printhead die. The electrochemical cell is to measure an electrical property of the fluid. The fluid-ejection firing element and the electrochemical cell are both part of the fluid-ejection printhead die.

14 Claims, 3 Drawing Sheets

FLUID-EJECTION PRINTHEAD DIE HAVING AN ELECTROCHEMICAL CELL

BACKGROUND

Fluid-ejection devices include fluid-ejection printhead dies that eject droplets of fluid. The fluid-ejection devices and their fluid-ejection printhead dies may have parameters that are adjusted based on the fluid that is ejected from the printhead dies. For example, these parameters may be different for fluids having aqueous or water-based solvents, as compared to for fluids having non-aqueous or non-water based solvents, such as ketone-based solvents like dimethyl sulfoxide (DMSO).

DETAILED DESCRIPTION

As noted in the background, fluid-ejection devices and their fluid-ejection printhead dies may have parameters that are adjusted based on the fluid that is ejected from the printhead dies. Traditionally, a user has to indicate to the fluid-ejection device the type of fluid that is to be ejected from the device's fluid-ejection printhead die. Alternatively, the type of fluid can be determined by using gravimetric scales, near-infrared techniques, or other approaches that may require significant and potentially costly additional equipment, either external to the fluid-ejection device or integrated within the fluid-ejection device.

By comparison, the inventors have developed a novel fluid-ejection printhead die that, in addition to including a fluid-ejection firing element like a thermal firing resistor, includes an electrochemical cell which measures an electrical property of the fluid, such as capacitance, impedance, inductance, or another type of electrical property. An electrical circuit can be used to determine a characterization of the fluid based on this electric property, such as the tau parameter of a resistive-capacitive response of the fluid in the case where the electrochemical cell measures the capacitance of the fluid. Based on this characterization of the fluid, the type of the fluid can then be determined.

As such, the inventive approach developed by the inventors does not require potentially costly additional equipment in order to determine the type of the fluid, nor does it require the user to manually indicate the type of the fluid. In some embodiments, the electrical chemical cell is formed within a passivation layer already present in the fluid-ejection printhead die to protect the fluid-ejection firing element from chemical and mechanical stress. As such, the electrical chemical cell is relatively easily and cost-effectively formed within the fluid-ejection printhead die.

The fluid-ejection printhead die thus has an unexpected use in addition to its normal expected use of ejecting fluid droplets. This unexpected use is namely to measure an electrical property of the fluid, like capacitance, so that the type of the fluid can be determined. Furthermore, in some embodiments, the type of the fluid can be determined completely digitally, without having to perform any analog-to-digital conversion, which also reduces the complexity and the cost of a fluid-ejection device that uses a fluid-ejection printhead die that can measure an electrical property of the fluid.

Figure 1:
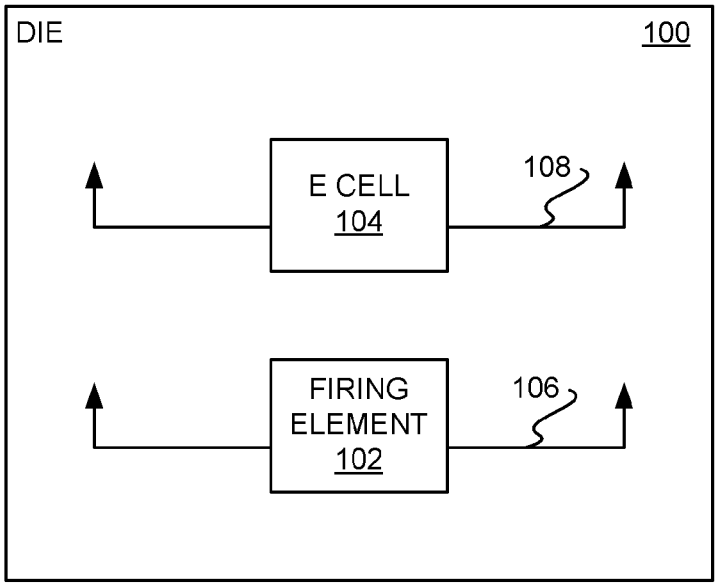
FIG. 1 is a block diagram of a top view of a fluid-ejection printhead die that includes a fluid-ejection firing element and an electrochemical cell, according to an embodiment of the present disclosure.

FIG. 1 shows a block diagram of a top view of a portion of a fluid-ejection printhead die 100, according to an embodiment of the disclosure. The printhead die 100 includes a fluid-ejection firing element 102 and an electrochemical cell 104. While just one fluid-ejection firing element 102 and just one electrochemical cell 104 are depicted, in actuality there are typically multiple firing elements 102, and there can be multiple electrochemical cells 104, on the printhead die 100.

The fluid-ejection firing element 102 causes droplets of fluid to be ejected from the printhead die 100. The fluid-ejection firing element 102 may be a thermal firing resistor, a piezoelectric firing element, or another type of fluid-ejection firing element. The electrochemical cell 104 measures the electrical property of the fluid, such as its capacitance, impedance, inductance, or other electrical property. The arrows 106 and 108 are cross-sectional lines to locate the views of FIGS. 2 and 3 in relation to FIG. 1.

Figure 2:
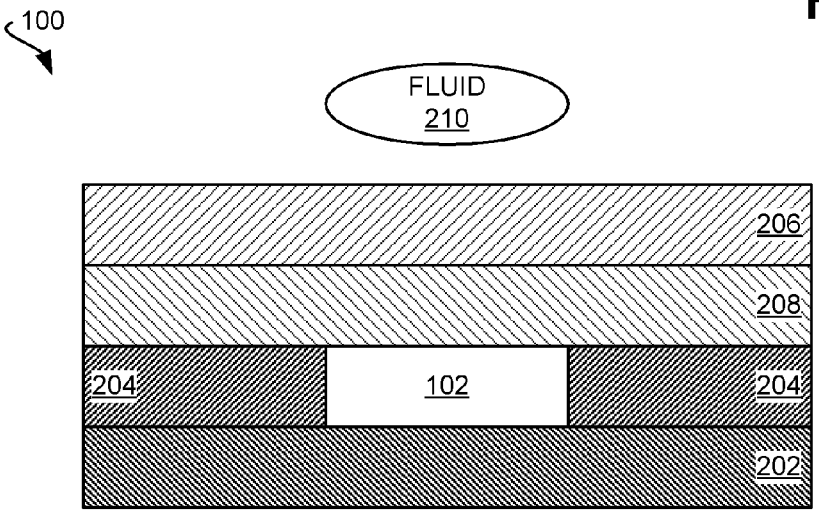
FIG. 2 is a diagram of a cross-sectional front view of a fluid-ejection firing element of a fluid-ejection printhead die, according to an embodiment of the present disclosure.

FIG. 2 shows a cross-sectional front view of the fluid-ejection printhead die 100 that includes the fluid-ejection firing element 102, pursuant to the arrows 106 of FIG. 1, according to an embodiment of the disclosure. In FIG. 2, the firing element 102 is particularly a thermal firing resistor. The printhead die 100 includes a substrate 202, a conductive layer 204, a first passivation layer 206, and a second passivation layer 208.

The substrate 202 may be formed from silicon or another material. The conductive layer 204 may be a metal, such as copper, gold, silver, aluminum, another type of metal or metal alloy, or another type of conductive material that is not a metal. The conductive layer 204 is disposed over the substrate 202 and under the passivation layers 206 and 208, and the firing element 102 is disposed within the conductive layer 204. The conductive layer 204 is electrically connected to the firing element 102, to permit the firing element 102 to be externally electrically addressed or otherwise accessed from outside the printhead die 100.

The passivation layers 206 and 208 protect the firing element 102. The first passivation layer 206 makes direct contact with fluid 210 that is ultimately ejected from the printhead die 100, and which is depicted within an oval in FIG. 2 for illustrative convenience. The first passivation layer may be tantalum, or another type of dielectric material. The second passivation layer 206 is disposed under the first passivation layer 206. The second passivation layer 208 may be silicon carbide, silicon nitride, and/or another type of material or materials.

The first passivation layer 206 protects the firing element 102 from mechanical and chemical stress. The second passivation layer 208 protects the firing element 102 from electrical and chemical stress. Mechanical stress results from the fluid 210 expanding due to its being heated by the firing element 102 where the element 102 is a thermal firing resistor. Chemical stress results from chemical properties of the fluid 210. Electrical stress results from electrical conductivity of the fluid 210.

Figure 3:
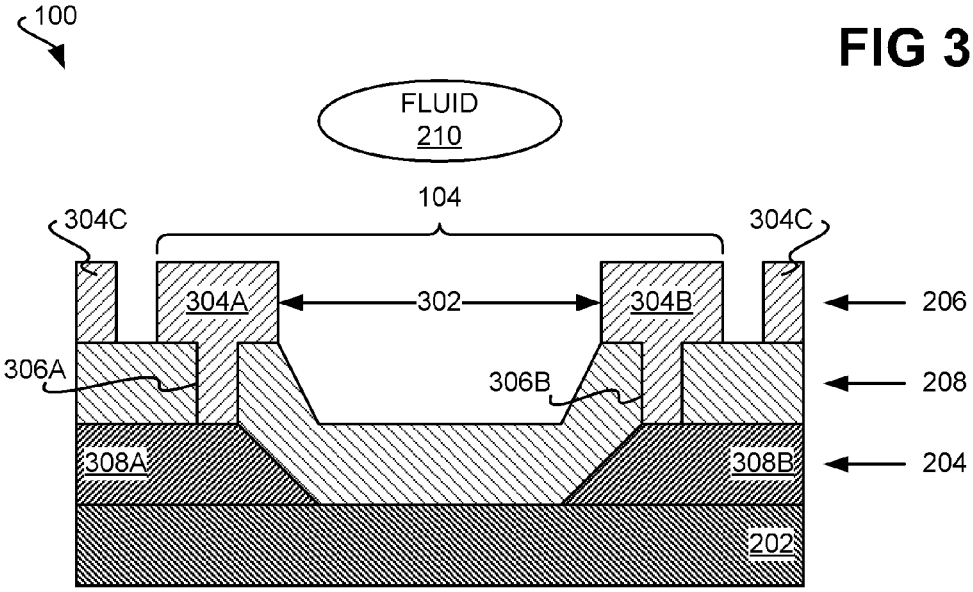
FIG. 3 is a diagram of a cross-sectional front view of an electrochemical cell of a fluid-ejection printhead die, according to an embodiment of the present disclosure.

FIG. 3 shows a cross-sectional view of the fluid-ejection printhead die 100 that includes the electrochemical cell 104, pursuant to the arrows 108 of FIG. 1, according to an embodiment of the disclosure. The electrochemical cell 104 is formed from a pair of isolated passivation layer portions 304A and 304B separated by a capacitive gap 302 of the cell 104, and which may also be referred to as an electrostatic gap. The isolated passivation layer portions 304A and 304B are part of the first passivation layer 206. The first passivation layer 206 is patterned so that the passivation layer portions 304A and 304B are physically and electrically isolated from one another and from other parts of the passivation layer 206, such as the passivation layer portions 304C.

The fluid 210 is again depicted as an oval for illustrative convenience. The fluid 210 fills the capacitive gap 302 between the isolated passivation layer portions 304 that make up the capacitive or electrostatic plates of the electrochemical cell 104. In the specific embodiment of FIG. 1, the electrochemical cell 104 measures the capacitance of the fluid 210, since the fluid 210 fills the capacitive gap 302 between the isolated passivation layer portions 304.

The second passivation layer 208 includes a pair of vias 306A and 306B that run completely through the passivation layer 208 to connect the isolated passivation layer portions 304A and 304B to the conductive layer 204. The conductive layer 204 includes a pair of conductive layer portions 308A and 308B that are electrically isolated or insulated from one another by the second passivation layer 208. The via 306A is filled with the material from which the first passivation layer 206 is formed to connect the isolated passivation layer portion 304A to the conductive layer portion 308A. The via 306B similarly is filled with the material from which the first passivation layer 206 is formed to connect the isolated passivation layer portion 304B to the conductive layer portion 308B.

The via 306A is thus located under the isolated passivation layer portion 304A and over the conductive layer portion 308A. Similarly, the via 306B is located under the isolated passivation layer 304B and over the conductive layer portion 308B. Electrically connecting the conductive layer portions 308A and 308B to the isolated passivation layer portions 304A and 304B through the vias 306A and 306B permits the electrochemical cell 104 to be externally electrically addressed or otherwise accessed from outside the printhead die 100. The printhead die 100 in FIG. 3 further includes the substrate 202, which may be silicon.

It is noted that the electrochemical cell 104 of FIG. 3 is formed from the same basic layers 202, 204, 206, and 208 that are already part of the printhead die 100 for the fluid-ejection firing element 102 of FIG. 2. The conductive layer 204 that is used to electrically access the firing element 102 is also used to electrically access the electrochemical cell 104. The first passivation layer 206 that protects the firing element 102 is patterned to make up the capacitive or electrostatic plates of the electrochemical cell 104 (i.e., the isolated passivation layer portions 304A and 304B), and to define the capacitive gap 302 of the electrochemical cell 104. The second passivation layer 206 that also protects the firing element 102 has vias 306A and 306B defined therethrough to electrically connect the isolated passivation layer portions 304A and 304B of the electrochemical cell 104 with the conductive layer portions 308A and 308B.

As such, the electrochemical cell 104 can be relatively easily fabricated on the printhead die 100 without undue cost and without additional materials beyond those already employed on the die 100 for the firing element 102. In particular, the vias 306A and 306B are formed through the second passivation layer 208 before the first passivation layer 206 is formed over the second passivation layer 208. After the second passivation layer 208 has been formed, the second passivation layer 208 is patterned to define the isolated passivation layer portions 304A and 304B.

Figure 4:
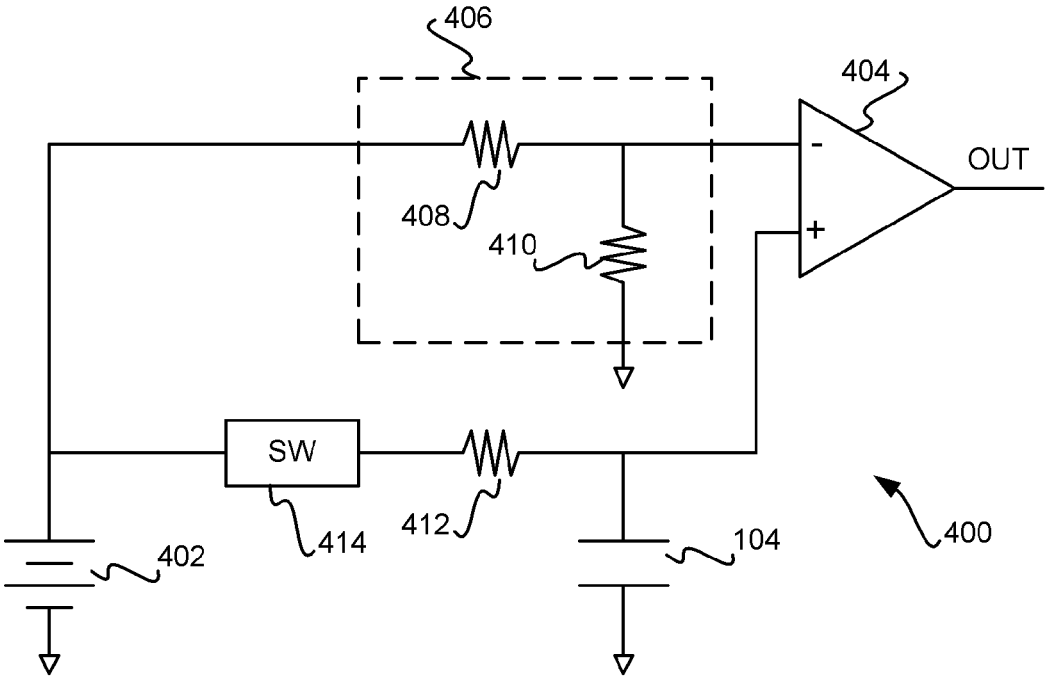
FIG. 4 is a diagram of an electrical circuit that determines a fluid characterization based on the capacitance of the fluid as measured by an electrochemical cell, according to an embodiment of the present disclosure.

FIG. 4 shows an electrical circuit 400 that can be used to determine what is referred to herein as a characterization of the fluid 210, based on the capacitance of the fluid 210 measured by the electrochemical cell 104, according to an embodiment of the disclosure. The electrochemical cell 104 is represented within the electrical circuit 400 as a capacitor. The electrical circuit 400 further includes a voltage source 402, a comparator 404, a resistor divider sub-circuit 406, a resistor 412, and a switch 414.

The voltage source 402 provides a predetermined voltage. The resistor divider sub-circuit 406 is connected between the voltage source 402 and the negative input of the comparator 404. As such, the resistor divider sub-circuit 406 sets the voltage at the negative input of the comparator 404 to be equal to a predetermined percentage of the voltage provided by the voltage source 402. Where the sub-circuit 406 includes a first resistor 408 having a resistance R1 and a second resistor 410 having a resistance R2 as depicted in FIG. 4, and where the voltage provided by the voltage source 402 is V, the voltage at the negative input of the comparator 404 is equal to the product of V and R2, divided by the sum of R1 and R2, or $$\frac{V * R2}{R1 + R2}.$$

The electrochemical cell 104 is connected to the positive input of the comparator 404. The resistor 412 is connected between the electrochemical cell 104 and the voltage source 402 as depicted in FIG. 4. When the switch 414 is closed, the voltage at the positive input increases over time in accordance with $$V_+ = V(1 - e^{\frac{-t}{\tau}}).$$

In this equation, V+ is the voltage at the positive input of the comparator 404 (i.e., the voltage over the electrochemical cell 104), V is the voltage provided by the voltage source 402, t is time, and $\tau$ is the tau parameter of the resistive-capacitive response of the fluid 210 within the electrical circuit 400. The tau parameter is specifically equal to RC, where R is the resistance of the resistor 412 and C is the capacitance of the fluid 210 as measured by the electrochemical cell 104. The tau parameter is therefore the characterization of the fluid 210 that the electrical circuit 400 determines in the embodiment of FIG. 4.

The comparator 404 outputs logic zero when the switch 414 is first closed, until the voltage over the electrochemical cell 104 at the positive input of the comparator 404 is equal to or greater than the predetermined percentage of the voltage provided by the voltage source 402 at the negative input of the comparator 404. In one embodiment, the resistances R1 and R2 of the resistors 408 and 410 of the resistor divider sub-circuit 406 are selected so that the voltage at the negative input of the comparator 404 is $V-=V(1-e)\approx 0.632V$. In this equation, V− is the voltage at the negative input of the comparator 404 and V is the voltage provided by the voltage source 402.

In this embodiment, then, the comparator 404 begins to output logic one at time $t=\tau$, since $V+=V-$ when $V+=V(1-e)\approx 0.632V$, which occurs when $t=\tau$ within the equation $$V_+ = V(1 - e^{\frac{-t}{\tau}}).$$

Therefore, the tau parameter is determined as equal to the time at which the output of the comparator 404 is logic one. Since the tau parameter is equal to the resistance of the resistor 412 and the capacitance of the fluid 210 as measured by the electrochemical cell 104, and because the resistance R of the resistor 412 is predetermined and thus known, the capacitance of the fluid 210 is determined by dividing the time at which the output of the comparator 404 is logic one by R. That is, $$C = \frac{t = \tau}{R},$$

where C is the capacitance of the fluid 210 as measured by the electrochemical cell 104.

The resistance of the resistor 412 is selected based on the range of expected capacitances of the fluid 210 that the electrochemical cell 104 is likely to measure. In particular, the lower the capacitance of the fluid 210 is expected to be, the higher the resistance of the resistor 412 that is selected. For example, for capacitances of the fluid 210 that are expected to be as low as one picofarad, the resistance of the resistor 412 may be selected as equal to 100 kilo-ohms.

Figure 5:
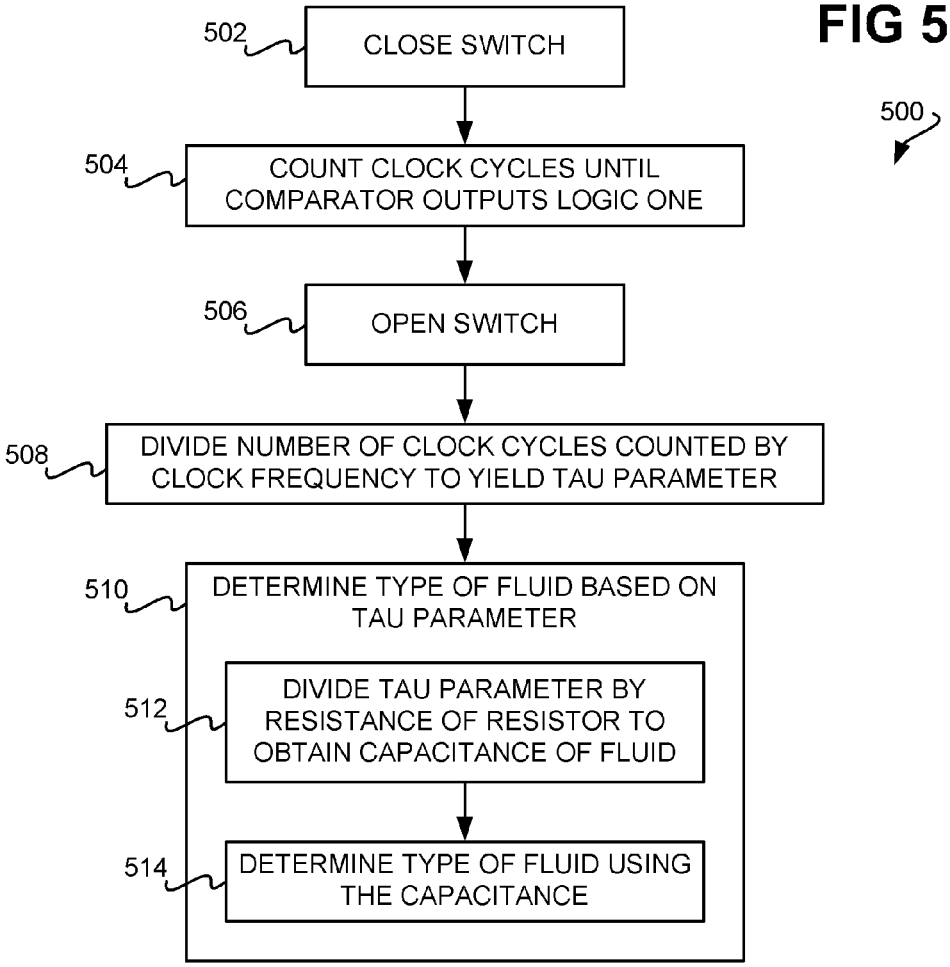
FIG. 5 is a flowchart of a method for digitally determining a tau parameter of a resistive-capacitive response of a fluid, as the characterization of the fluid, and for determining the type of the fluid, according to an embodiment of the present disclosure.

FIG. 5 shows a method 500 for digitally determining the time t at which $t=\tau$ after the switch 414 of the electrical circuit 400 has been closed, and for determining the type of the fluid 210 based on this tau parameter, without the need for analog-to-digital conversion, according to an embodiment of the disclosure. A fluid-ejection device of which the fluid-ejection printhead die 100 is a part typically includes a clock that has a given frequency. The method 500 leverages this clock to digitally determine the tau parameter.

The switch 414 of the electrical circuit 400 is closed (502). The number of clock cycles that elapse until the comparator 404 of the electrical circuit 400 has outputted logic one is counted (504), after which the switch 404 can again be opened (506). The number of clock cycles counted is divided by the clock frequency to yield or obtain the tau parameter (508). Since the frequency of the clock can be specified as f clock cycles per second, in other words, where n clock cycles have been counted, the tau parameter is $$\tau = \frac{n}{f}.$$

Note that this approach to determine the tau parameter does not involve any type of analog-to-digital conversion, because the clock cycles are counted digitally until the output of the comparator 404 is logic one. Not having to perform any type of analog-to-digital conversion to determine the tau parameter as the characterization of the fluid 210 is advantageous. This is because potentially expensive analog-to-digital converters do not have to be included as part of the fluid-ejection device of which the fluid-ejection printhead die 100 is a part, and do not have to be included as part of the electrical circuit 400 that is also part of this fluid-ejection device.

The type of the fluid 210 can then be determined based on the tau parameter, or other characterization, of the fluid 210 that has been determined (510). In one particular embodiment, for instance, the tau parameter of the resistive-capacitive response of the fluid 210 is divided by the resistance of the resistor 412 of the electrical circuit 400 to obtain the capacitance of the fluid 210 as measured by the electrochemical cell 104 (512). The type of the fluid 210 may then be determined using this capacitance (514). For example, a look-up table may be referenced to determine the type of the fluid 210 based on its capacitance (or based on its tau parameter or other characterization), and thus to determine how the parameters of the fluid-ejection device should be adjusted to properly eject droplets of this type of fluid.

Figure 6:
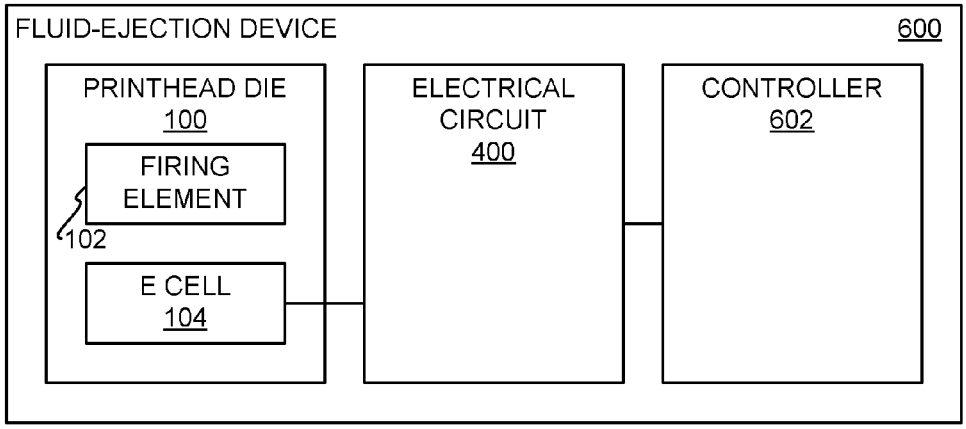
FIG. 6 is a diagram of a rudimentary fluid-ejection device, according to an embodiment of the present disclosure.

In conclusion, FIG. 6 shows a block diagram of a rudimentary fluid-ejection device 600, according to an embodiment of the disclosure. The fluid-ejection device 600 includes the printhead die 100, the electrical circuit 400, and a controller 602. The fluid-ejection device 600 typically includes other components, in addition to those depicted in FIG. 6. The printhead die 100 includes the firing element 102 and the electrochemical cell 104 that have been described, and the electrical circuit 400 in one embodiment uses the electrochemical cell 104 as a capacitor, as has also been described. More generally, the electrical circuit 400 uses the electrical property of the fluid that the electrical chemical cell 104 measures. As such, in some embodiments, the electrical circuit 400 can use the capacitance of the fluid that is measured by the electrochemical cell 104, whereas in other embodiments, the electrical circuit 400 can use a different electrical property that is measured by the cell 104, other than capacitance.

The controller 602 controls the electrical circuit 400 to determine the characterization of the fluid 210, in order to determine the type of the fluid 210 based on this characterization. The controller 602 is typically implemented in hardware, such as an application-specific integrated circuit (ASIC), but may also be implemented in combination of software and hardware. The controller 602 may thus digitally determine the tau parameter of the resistive-capacitive response of the fluid 210 without using analog-to-digital conversion, by dividing the number of clock cycles that elapse until the electrical circuit 400 outputs logic one, by the clock frequency of the fluid-ejection device 600. In this respect, then, the controller 602 may be considered as performing the method 500 that has been described.

It is finally noted that the fluid-ejection device 600 may be an inkjet-printing device, which is a device, such as a printer, that ejects ink onto media, such as paper, to form images, which can include text, on the media. The fluid-ejection device 600 is more generally a fluid-ejection precision-dispensing device that precisely dispenses fluid, such as ink. The fluid-ejection device 600 may eject pigment-based ink, dye-based ink, another type of ink, or another type of fluid. Examples of other types of fluid include those having water-based or aqueous solvents, as well as those having non-water-based or non-aqueous solvents, such as ketone-based solvents like dimethyl sulfoxide (DMSO). The ketone-based solvent DMSO is particularly used to dissolve pharmaceutical drug ingredients within fluid. Embodiments of the present disclosure can thus pertain to any type of fluid-ejection precision-dispensing device that dispenses a substantially liquid fluid.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids thus include drugs, cellular products, organisms, fuel, and so on, which are not substantially or primarily composed of gases such as air and other types of gases, as can be appreciated by those of ordinary skill within the art.

We claim:

1. A fluid-ejection printhead die comprising:

a fluid-ejection firing element to cause droplets of fluid to be ejected from the fluid-ejection printhead die;

an electrochemical cell to measure an electrical property of the fluid; and a passivation layer to protect the fluid-ejection firing element, wherein the fluid-ejection firing element and the electrochemical cell are both part of the fluid-ejection printhead die, and wherein the passivation layer comprises:

a pair of isolated passivation layer portions, the isolated passivation layer portions isolated from one another and from other parts of the passivation layer, the isolated passivation layer portions forming the electrochemical cell.

2. The fluid-ejection printhead die of claim 1, wherein the isolated passivation layer portions are separated by a gap corresponding to a capacitive gap of the electrochemical cell.

3. The fluid-ejection printhead die of claim 1, wherein the passivation layer is a first passivation layer, and the fluid-ejection printhead die further comprises:

a second passivation layer under the first passivation layer to also protect the fluid-ejection firing element;

a conductive layer under the second passivation layer;

a pair of vias through the second passivation layer and under the isolated passivation layer portions to electrically connect the isolated passivation layer portions to the conductive layer, to permit the electrochemical cell to be externally accessed.

4. The fluid-ejection printhead die of claim 3, wherein the conductive layer comprises:

a first conductive layer portion under a first via of the pair of vias; and, a second conductive layer portion under a second via of the pair of vias and electrically isolated from the first conductive layer portion.

5. The fluid-ejection printhead die of claim 4, wherein the second conductive layer portion is electrically isolated from the first conductive layer portion by the second passivation layer.

6. The fluid-ejection printhead die of claim 3, wherein the first passivation layer comprises a given material, the given material further filling the vias from the isolated passivation layer portions through the second passivation layer and to the conductive layer.

7. The fluid-ejection printhead die of claim 3, wherein the first passivation layer comprises tantalum, and the second passivation comprises one or more of silicon carbide and silicon nitride.

8. A fluid-ejection device comprising:

a fluid-ejection printhead die to cause droplets of fluid to be ejected, and having an electrochemical cell to measure an electrical property of the fluid;

an electrical circuit to determine a characterization of the fluid based on the electrical property of the fluid measured by the electrochemical cell; and, a controller to control the electrical circuit to determine the characterization of the fluid, and to determine a type of the fluid based on the characterization of the fluid.

9. The fluid-ejection device of claim 8, wherein the characterization of the fluid comprises a tau parameter of a resistive-capacitive response of the fluid.

10. The fluid ejection device of claim 9, wherein the controller is to digitally determine the tau parameter without using an analog-to-digital conversion, by dividing a number of clock cycles that elapse until the electrical circuit outputs a logic one by a clock frequency.

11. The fluid-ejection device of claim 9, wherein a voltage over the electrochemical cell is equal to a voltage of a voltage source of the electrical circuit, times the difference between one and $$e^{\frac{-t}{\tau}},$$

where t is time and $\tau$ is the tau parameter.

12. The fluid-ejection device of claim 9, wherein the electrical circuit comprises:

a voltage source having a voltage;

a comparator having a positive input and a negative input, the electrochemical cell connected to the positive input;

a resistor divider sub-circuit connected to the negative input of the comparator so that a voltage at the negative input is a predetermined percentage of the voltage of the voltage source; and, a resistor connected between the electrochemical cell and the voltage source, the resistor having a resistance selected to permit determination of the tau parameter, where the tau parameter is equal to the resistance multiplied by a capacitance of the fluid, where the electrical property of the fluid is the capacitance of the fluid.

13. A method comprising:

counting a number of clock cycles that elapse until an electrical circuit connected to an electrochemical cell of a fluid-ejection printhead die outputs a logic one;

dividing the number of clock cycles by a clock frequency to yield a tau parameter of a resistive-capacitive response of fluid within the fluid-ejection printhead die; and, determining a type of the fluid based on the tau parameter.

14. The method of claim 13, wherein determining the type of the fluid based on the tau parameter comprises:

dividing the tau parameter by a resistance of a resistor of the electrical circuit to obtain a capacitance of the fluid measured by the electrochemical cell; and, determining the type of the fluid using the capacitance of the fluid.

* * * * *